United States Patent [19]

Tanaka et al.

[11] Patent Number: 4,757,539

[45] Date of Patent: Jul. 12, 1988

[54] APPARATUS AND METHOD FOR DECODING AN AM STEREO BROADCASTING SIGNAL OF AN INDEPENDENT SIDEBAND SYSTEM

[75] Inventors: Kanji Tanaka; Masashi Arai, both of Gunma, Japan

[73] Assignee: Sanyo Electric Co., Ltd., Japan

[21] Appl. No.: 940,004

[22] Filed: Dec. 10, 1986

[30] Foreign Application Priority Data

Dec. 19, 1985 [JP] Japan ..... 60-286517
Dec. 20, 1985 [JP] Japan ..... 60-288337

[51] Int. Cl.[4] ..... H04H 5/00
[52] U.S. Cl. ..... 381/15
[58] Field of Search ..... 381/2, 3, 4, 15, 16

[56] References Cited

U.S. PATENT DOCUMENTS 4,371,747 2/1983 Hilbert ..... 381/15
4,466,116 8/1984 Streeter ..... 381/15

*Primary Examiner*—Forester W. Isen

*Attorney, Agent, or Firm*—Darby & Darby

[57] ABSTRACT

In an AM stereo receiving apparatus for decoding an AM stereo broadcasting signal of an ISB system, an envelope detecting circuit 6 detects an output of an intermediate frequency amplifying circuit 5 and a DC removing circuit 7 removes a DC component therefrom, so that a stereo sum signal (L+R) is obtained. A quadrature detecting circuit 9 detects quadrature of the output of the intermediate frequency amplifying circuit 5. A multiplying circuit 10 multiplies the stereo sum signal (L+R), which is amplified a times as much by a first amplifying circuit 8, and the output of the quadrature detecting circuit 9. An addition circuit 12 adds the output of the quadrature detecting circuit 9, which is amplified b times as much by a second amplifying circuit 11, and the output of the multiplying circuit 10. The output of the addition circuit 12 becomes a stereo difference signal (L−R) by appropriately setting the amplification factor a of the first amplifying circuit 8 and the amplification factor b of the second amplifying circuit 11.

8 Claims, 4 Drawing Sheets

APPARATUS AND METHOD FOR DECODING AN AM STEREO BROADCASTING SIGNAL OF AN INDEPENDENT SIDEBAND SYSTEM

BACKGROUND OF THE INVENTION

1. Field of the Invention

The present invention relates to an apparatus and a method for decoding an AM stereo broadcasting signal of an independent sideband system and particularly to an apparatus and a method for reducing distortion of a stereo difference signal at the time of decoding an AM stereo broadcasting signal of the independent sideband system.

2. Description of the Prior Art

Several proposals have been made concerning an AM stereo broadcasting system. One of them is an independent sideband system (referred to hereinafter as ISB system) in which a left stereo signal L and a right stereo signal R are carried onto an upper sideband and a lower sideband, respectively, of a carrier, disclosed for example in U.S. patent Ser. No. 4,018,994. According to the ISB AM stereo broadcasting system of this document, a carrier is subjected to amplitude modulation by a sum signal (L+R) phase-shifted by +45° and is also subjected to phase modulation by a difference signal (L−R) phase-shifted by −45°, whereby the left stereo signal L and the right stereo signal R are modulated to the lower sideband and the upper sideband, respectively. However, only by modulation of the carrier, a vector formed by phase modulation does not have always 90° with respect to the carrier and an error is caused, resulting in distortion of a signal at the time of decoding thereof.

As a method for solving such problem, a reverse modulation system is proposed for example in U.S. patent application No. 912,281 filed May 5, 1978.

However, the reverse modulation system involves a problem that a circuit for reverse modulation of a carrier has a more complex configuration. In addition, there is involved a further problem that in order to precisely compensate for distortion of a signal, it is necessary to set a reverse modulation function with an extremely high precision, making precise control of the circuit necessary.

SUMMARY OF THE INVENTION

The present invention has been accomplished to solve the above described problems and it is a primary object of the present invention to provide an apparatus and a method for decoding an AM stereo broadcasting signal of an ISB system without distortion in a relatively simple circuit configuration.

Another object of the present invention is to provide an apparatus and a method for decoding an AM stereo broadcasting signal of an ISB system in which a signal having little noise can be decoded in a weak electric field strength.

The present invention uses a quadrature detecting circuit for the purpose of decoding a stereo difference signal and an output signal therefrom is corrected by an output signal (a stereo sum signal) of an envelope detecting circuit so that distortion of the stereo difference signal is compensated.

According to the present invention, a stereo difference signal with little distortion can be obtained. In addition, the present invention makes it possible to provide an apparatus and a method for decoding an AM stereo broadcasting signal of an ISB system in which noise levels will not be produced. Further, it makes it possible to provide an apparatus and a method for decoding in which compensation of distortion can be made efficiently even if the electric field strength of a received signal is changed. Furthermore, according to the present invention, it is not necesssary to adjust amplitudes of a stereo sum signal and a stereo difference signal decoded by the present invention before evaluation of those signals by the matrix decoder.

These objects and other objects, features, aspects and advantages of the present invention will become more apparent from the following detailed description of the present invention when taken in conjunction with the accompanying drawings.

DESCRIPTION OF THE RELATED ART AND THE PREFERRED EMBODIMENTS

An example of a circuit configuration for receiving and decoding AM stereo broadcasting of the ISB system without distortion is disclosed in Japanese Patent Laying-Open Gazette No. 140944/1985. In an apparatus described in this Gazette, a received AM stereo signal undergoes AM detection in a first detecting circuit and then undergoes phase detection in a second detecting circuit. The output signal of the first detecting circuit is amplified in a first amplifying circuit and is multiplied in a multiplying circuit by the output signal of the second detecting circuit. The output signal of the multiplying circuit is further amplified in a second amplifying circuit so as to be applied to an addition circuit. In the addition circuit, the output signal of the second amplifying circuit and the output signal of the second detecting circuit are added so that a stereo difference signal (L−R) without distortion is generated at an output terminal.

The technique described in the above stated Laying-Open Gazette, however, involves a problem in that a significant amount of noise is produced from the phase detecting circuit when the level of the input signal is less than a prescribed value by reason of a weak electric field strength signal is received. Such a large noise is caused by amplification of a noise when the level of the received signal becomes lower than the level of a limiter circuit which is provided at a stage preceding the phase detecting circuit to make an amplitude value constant for the purpose of phase detection.

In an embodiment of the present invention, in order to decode a stereo difference signal without phase detection, for which a limiter circuit is necessary, a quadrature detecting circuit is used and there is also provided means for removing a distortion component from an output of the quadrature detecting circuit.

Figure 1:
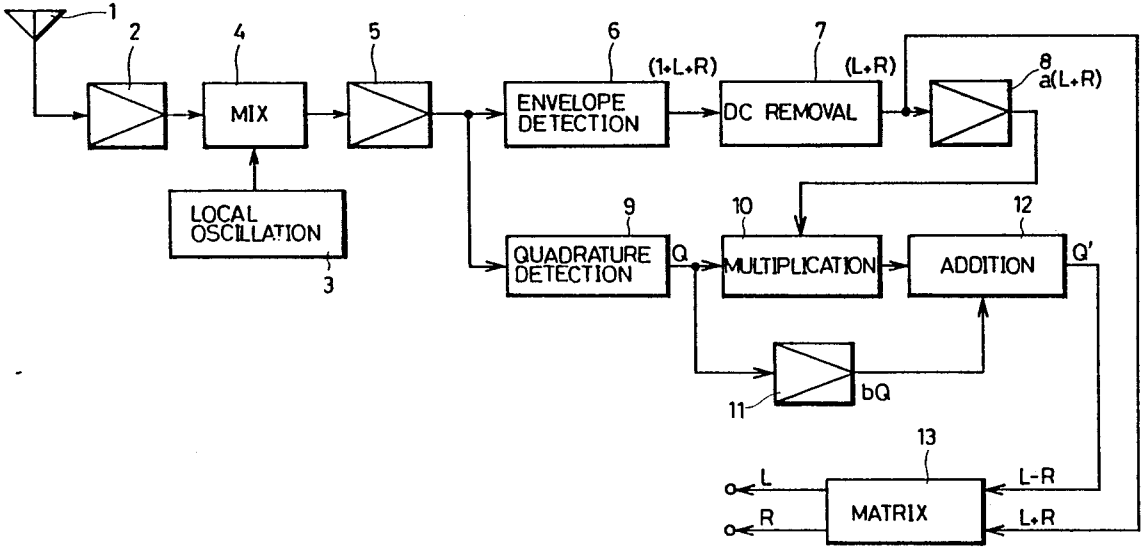
FIG. 1 is a circuit block diagram showing a configuration of an AM stereo receiving apparatus of a first embodiment of the present invention.

FIG. 1 is a circuit block diagram showing an AM stereo receiving apparatus of a first embodiment of the present invention. The AM stereo receiving apparatus of this first embodiment comprises: an antenna 1 for receiving an AM stereo signal; a radio frequency amplifying circuit 2 for amplifying a signal received by the antenna 1; a local oscillation circuit 3; a mixing circuit 4 for mixing an output signal of the radio frequency amplifying circuit 2 and an output signal of the local oscillation circuit 3 to produce an intermediate frequency signal; an intermediate frequency amplifying circuit 5 for amplifying an output signal of the mixing circuit 4; an envelope detecting circuit 6 for AM detection of an output signal of the intermediate frequency amplifying circuit 5; and a DC removing circuit 7 for removing a DC component contained in an output signal of the envelope detecting circuit 6, an output of this circuit 7 being a stereo sum signal (L+R). The AM stereo receiving apparatus of this first embodiment further comprises: a first amplifying circuit 8 for amplifying an output signal of the DC removing circuit 7; a quadrature detecting circuit 9 for quadrature detection of an output signal of the intermediate frequency amplifying circuit 5; a multiplying circuit 10 for multiplying an output signal of the first amplifying circuit 8 and an output signal of the quadrature detecting circuit 9; a second amplifying circuit 11 for amplifying the output signal of the quadrature detecting circuit 9; an addition circuit 12 for adding an output signal of the multiplying circuit 10 and an output signal of the second amplifying circuit 11, an output of the addition circuit 12 being a stereo difference signal (L−R); and a matrix circuit 13 for evaluating by a matrix decoder the stereo sum signal (L+R) and the stereo difference signal (L−R).

Now, assuming that the antenna 1 receives an AM stereo broadcasting signal of the ISB system, the received signal is amplified in the radio frequency amplifying circuit 2 and the amplified received signal is converted by the mixing circuit 4 to an intermediate frequency signal, which is amplified in the intermediate frequency amplifying circuit 5. An output signal of the intermediate frequency amplifying circuit 5 undergoes AM detection in the envelope detecting circuit 6 and undergoes quadrature detection in the quadrature detecting circuit 9. An output signal of the envelope detecting circuit 6 becomes a stereo sum signal containing a DC component (1+L+R) and an output signal Q of the quadrature detecting circuit 9 becomes as follows.

$$Q = \frac{(L-R)(1+L+R)}{1+0.5(L+R)} \tag{1}$$

The DC component out of the output signal (1+L+R) of the envelope detecting circuit 6 is removed by the DC removing circuit 7 so that the stereo sum signal (L+R) is obtained. The stereo sum signal (L+R) is supplied to the matrix circuit 13 and it is also amplified a times as much in the first amplifying circuit 8 so that a(L+R) is obtained.

The output signal Q of the quadrature detecting circuit 9 is supplied to the multiplying circuit 10 so as to be multiplied by the output signal a(L +R) of the first amplifying circuit 8 and the output signal Q is also supplied to the second amplifying circuit 11 so as to be amplified b times as much. Accordingly, the output signal Q′ of the addition circuit 12, which is obtained by addition of the output signal of the multiplying circuit 10 and the output signal of the second amplifying circuit 11, is expressed as follows.

$$Q' = \frac{(L-R)(1+L+R)}{1+0.5(L-R)}\{a(L+R)+b\} \tag{2}$$

A second high harmonic wave distortion component contained in the above stated output signal Q′ of the addition circuit 12 can be removed from the output signal Q′ by appropriately setting an amplification factor a of the first amplifying circuit 8 and an amplification factor b of the second amplifying circuit 11. Thus, the output signal Q′ of the addition circuit 12 can be made to be a signal approximate to the stereo difference signal (L−R). Consequently, the thus obtained stereo difference signal (L−R) is supplied to the matrix circuit 13 and the matrix circuit 13 forms a matrix of the stereo sum signal (L+R) and the stereo difference signal (L−R), whereby the right stereo signal R and the left stereo signal L are otained.

In the following, detailed description will be made on the method for making the output Q′ of the addition circuit 12 approximate to the stereo difference signal (L−R) by appropriately setting the amplification factor a of the first amplifying circuit 8 and the amplification factor b of the second amplifying circuit 11.

If the conditions $L-R = m\cdot\sin\theta$ and $L+R = m\cdot\cos\theta$ (m being a modulation factor) are given, the output signal Q of the quadrature detecting circuit 9 is expressed as follows.

$$Q = \frac{m\cdot\sin\theta(1+m\cdot\cos\theta)}{1+0.5\,m\cdot\cos\theta} \tag{3}$$

$$\text{If } \frac{1}{1+0.5\,m\cdot\sin\theta} \approx 1 - \tfrac{1}{2}\,m\cdot\sin\theta + \tfrac{1}{4}\,m^2\cdot\sin^2\theta,$$

the equation (3) becomes as follows.

$$Q = \left(m - \frac{m^3}{16}\right)\sin\theta + \left(\frac{m^2}{4} + \frac{m^4}{16}\right)\sin 2\theta + \frac{m^3}{16}\sin 3\theta + \frac{m^4}{32}\sin 4\theta \tag{4}$$

The output signal aQ(L+R) of the multiplying circuit 10 is represented as follows.

$$aQ(L+R) = a\left\{\left(\frac{m^3}{8} + \frac{m^5}{32}\right)\sin\theta + \left(\frac{m^2}{2} - \frac{m^4}{16}\right)\sin 2\theta + \left(\frac{m^3}{8} + \frac{3m^6}{64}\right)\sin 3\theta - \frac{m^4}{32}\sin 4\theta + \frac{m^5}{64}\sin 5\theta\right\} \tag{5}$$

Since the output signal Q′ of the addition circuit 12 is represented by the following equation (6), $$Q' = b\left\{Q + \frac{a}{b}(L+R)Q\right\} \tag{6}$$

if the equations (4) and (5) are substituted into the equation (6) to remove the second high harmonic wave distortion component, the above stated output Q' is calculated by the following equation (7) assuming that $a/b=-\frac{1}{2}$.

$$Q' = \left(m - \frac{m^3}{8} - \frac{m^5}{64}\right)\sin\theta + \frac{3}{32}m^4 \cdot \sin 2\theta - \frac{3}{128}m^5 \cdot \sin 3\theta + \frac{3}{64}m^4 \cdot \sin 4\theta \quad (7)$$

Assuming that the modulation factor m is $m<0.5$, the relations $m^3$, $m^4$, $m^5 << m$ are established in the above indicated equation and consequently the following equation (8) is obtained.

$$Q' = m \cdot \sin\theta = L - R \quad \ldots (8)$$

Thus, it can be understood that there is a signal with an improved distortion factor excluding the second high harmonic wave distortion component $m^2$ from the output signal Q' of the addition circuit 12. In other words, the stereo difference signal (L−R) is obtained by appropriately setting the amplification factors a and b of the first and second amplifying circuits 8 and 11, respectively.

In general, a distortion factor THD of a received broadcasting signal is represented as follows.

$$THD = \frac{\sqrt{(\text{2nd } HD)^2 + (\text{3rd } HD)^2 + \cdots}}{\text{fundamental wave}} \times 100\% \quad (9)$$

where

2nd HD: a second high harmonic wave distortion component

3rd HD: a third high harmonic wave distortion component.

Based on this equation (9), a distortion factor of the output signal Q of the quadrature detecting circuit 9 and a distortion factor of the output signal Q' of the addition circuit 12 can be calculated by changing the modulation factor m. The following table shows the results of the calculation. From this table, it can be understood that the distortion factor of the output signal Q' of the addition circuit 12 is sufficiently improved.

TABLE

| m | THD at addition circuit 9 | THD at quadrature detecting circuit |
|---|---|---|
| 0.1 | 0.1% | 2.50% |
| 0.2 | 0.08% | 5.07% |
| 0.3 | 0.29% | 7.73% |
| 0.4 | 0.69% | 10.55% |
| 0.5 | 1.37% | 13.59% |

Since the output signal Q of the quadrature detecting circuit 9 is a product between a phase component and an amplitude component, in order to obtain the amplitude component by quadrature detection, the input signal of the quadrature detecting circuit 9 needs to be supplied without limitation of amplitude. Accordingly, if the weak electric field strength signal is received and the input signal level is low, the signal is supplied to the quadrature detecting circuit 9 with the amplitude level being unchanged. As a result, a large noise never occurs in quadrature detection even if the level of the input signal is lowered, as is different from the case of phase detection.

In addition, since the stereo sum signal (L+R) and the stereo difference signal (L−R) supplied to the matrix circuit 13 do not pass through a limiter circuit or the like, there is an advantage that it is not necessary to regulate the amplitudes of the signals at a stage preceding the matrix circuit 13.

Figure 2:
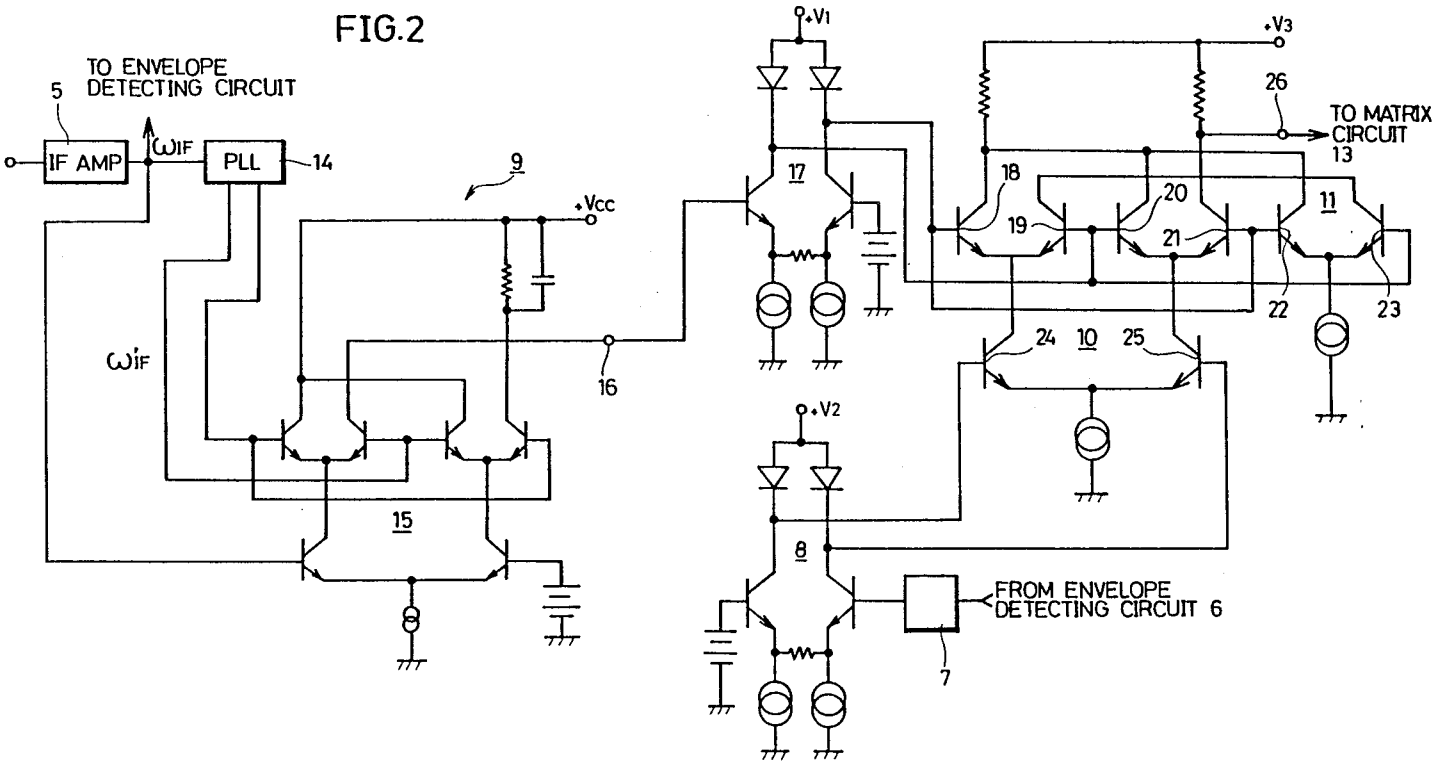
FIG. 2 is a circuit diagram showing a detailed configuration of a portion circuit for decoding a stereo difference signal in the circuit shown in FIG. 1.

FIG. 2 is a circuit diagram showing a detailed example of an essential portion of the circuit shown in FIG. 1. More specifically, the circuit diagram in FIG. 2 is a detailed circuit diagram showing the quadrature detecting circuit 9, the multiplying circuit 10, the second amplifying circuit 11 and the addition circuit 12.

Referring to FIG. 2, the quadrature detecting circuit 9 comprises a phase-locked loop (PLL) circuit 14 and a multiplying circuit 15. The PLL circuit 14 is locked to a carrier frequency $\omega_{IF}$ of the output signal of the intermediate frequency amplifying circuit 5 so that a signal $\omega'_{IF}$ having a phase different by 90° from that of the carrier frequency $\omega_{IF}$ of the intermediate frequency signal is provided from the PLL circuit 14. The intermediate frequency signal $\omega_{IF}$ and the signal $\omega'_{IF}$ obtained from the PLL circuit 14 are multiplied in the multiplying circuit 15 so that a quadrature detection output is provided to the output terminal 16 of the quadrature detecting circuit 9.

The detection output signal of the quadrature detecting circuit 9 is applied to the bases of the first to fourth transistors 18 to 21 of the multiplying circuit 10 through a buffer amplifying circuit 17 and it is also applied to the bases of the fifth and sixth transistors 22 and 23 of the second amplifying circuit 11.

On the other hand, the envelope detection signal from which the DC component has been removed by the DC removing circuit 7, namely, the stereo sum signal (L+R) is amplified in the first amplifying circuit 8 having the amplification factor a and the amplified signal is applied to the bases of the seventh and eighth transistors 24 and 25 of the multiplying circuit 10. As a result, the output signal of the buffer amplifying circuit 17 and the output signal of the first amplifying circuit 8 are multiplied in the multiplying circuit 10 so that the result of the multiplication appears at the collectors of the first to fourth transistors 18 to 21. The collector of the first transistor 18 and the collector of the third transistor 20 are connected commonly to the collector of the fifth transistor 22 and the collector of the second transistor 19 and the collector of the fourth transistor 21 are connected commonly to the collector of the sixth transistor 23. Thus, the output signal of the multiplying circuit 10 and the output signal of the second amplifying circuit 11 are added so that the stereo difference signal (L−R) with distortion being compensated is provided to the output terminal 26.

In the following, a second embodiment of the present invention will be described.

Figure 3:
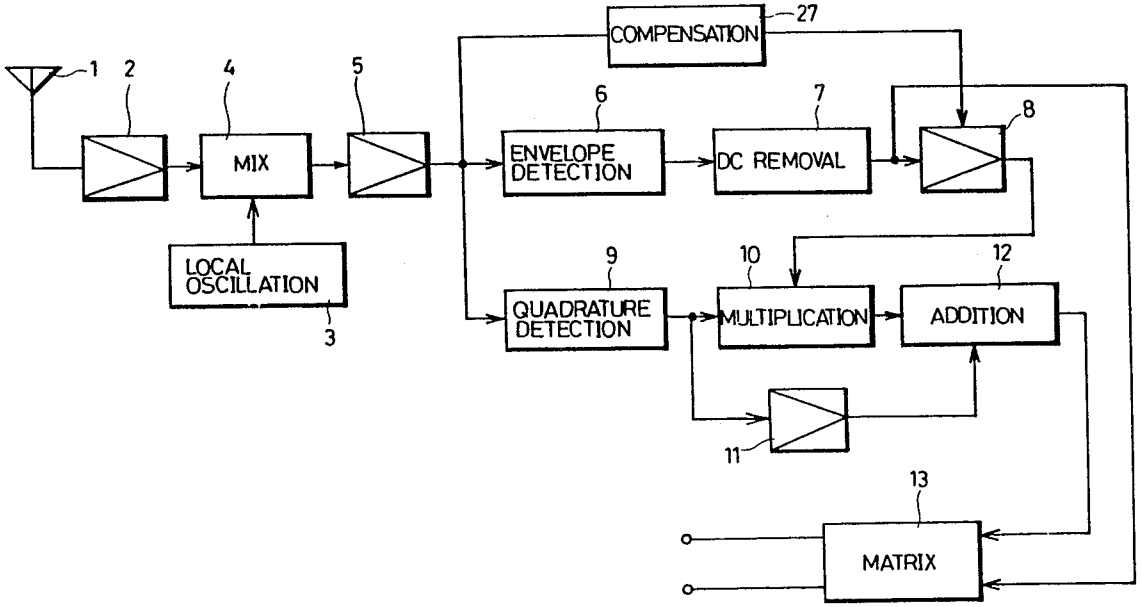
FIG. 3 is a circuit diagram showing an AM stereo receiving apparatus of a second embodiment of the present invention.

FIG. 3 is a circuit block diagram showing a circuit configuration of an AM stereo receiving apparatus of the second embodiment of the present invention. In FIG. 3, the same reference numerals as in the first embodiment described previously with reference to FIG. 1 indicate the same or corresponding portions. Therefore, description of those portions is omitted hereinafter. A characteristic feature of the second embodiment shown in FIG. 3 resides in that there is provided a correction circuit 27 for correcting the amplification factor of the first amplifying circuit 8 based on the output of the intermediate frequency amplifying circuit 5. The reason for providing the correction circuit 27 and the advantageous effect achieved by the correction circuit 27 will be described in the following.

Assuming that the stereo sum signal (L+R) as the output signal of the DC removing circuit 7 is E and that the output signal of the quadrature detecting circuit 9 is Q, the output signal Q' of the addition circuit 12 is expressed by the following equation (10) since the multiplying circuit 10, the second amplifying circuit 11 and the addition circuit 12 operate in the same manner as in the first embodiment.

$$Q' = bQ + aEQ \quad \ldots (10)$$

Since the output signals E and Q are respectively proportional to the electric field strength of the signal received by the antenna 1, the term bQ in the above indicated equation (10) is proportional to the electric field strength M and the term aEQ in the above indicated equation (10) varies directly as square of the electric field strength M. More specifically, if the following conditions:

$$E = \alpha ME', \quad Q = \beta MQ''$$

are given, the following equation (11) is obtained.

$$\begin{aligned} Q' &= bQ + aEQ \\ &= b\beta MQ'' + a\alpha\beta M^2E'Q'' \end{aligned} \quad (11)$$

As a result, if the electric field strength M is changed, a sufficiently precise compensation of distortion can not be made.

Therefore, in the second embodiment, the correction circuit 27 is provided so that a signal:

$$1/(\alpha M)$$

is obtained according to the electric field strength M provided from the intermediate frequency amplifying circuit 5 and is applied to the first amplifying circuit 8 as an amplification factor change signal. Thus, the amplification factor of the first amplifying circuit 8 is expressed by:

$$a/(\alpha M) \quad \ldots (12)$$

and the output signal of the first amplifying circuit 8 is expressed by:

$$(aE)/(\alpha M) \quad \ldots (13)$$

Consequently, the signal outputted from the addition circuit 12 is expressed as follows.

$$\begin{aligned} Q' &= bQ + (aEQ)/(\alpha M) \\ &= \beta M(bQ'' + aE'Q'') \end{aligned} \quad (14)$$

Thus, it can be understood that compensation of distortion can be made precisely even if the electric field strength is changed.

Figure 4:
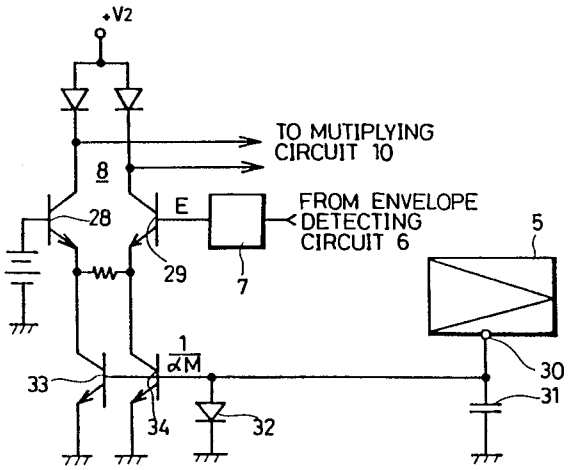
FIG. 4 is a circuit diagram showing a detailed example of an essential portion of the block diagram shown in FIG. 3.

FIG. 4 is a diagram showing an example of a portion of the circuit block diagram shown in FIG. 3. More specifically, FIG. 4 shows an example of the first amplifying circuit 8 and the correction circuit 27 for correcting the amplification factor of the circuit 8 shown in the block diagram of FIG. 3.

Referring to FIG. 4, the output signal E of the DC removing circuit 7 is differentially applied to the bases of the transistors 28 and 29 of the first amplifying circuit 8 having the amplification factor a.

The intermediate frequency amplifying circuit 5 is normally provided with a terminal 30 for driving a electric field strength measuring device, for example, a level meter and a DC signal proportional to the electric field strength for driving the level meter appears at the terminal 30. A capacitor 31 and a diode 32 of the correction circuit 27 control the operation current of the first amplifying circuit 8 having the amplification factor a. More specifically, the signal $1/(\alpha M)$ outputted from the correction circuit 27 is applied to the bases of the power supply transistors 33 and 34 of the first amplifying circuit 8. As a result, in the first amplifying circuit 8, the output signal E of the DC removing circuit 7 and the output signal $1/(\alpha M)$ of the correction circuit 27 are multiplied so that an output amplified a times as much is obtained. The output of the first amplifying circuit 8 is supplied to the multiplying circuit 10 in the same manner as in the above described circuit shown in FIG. 2.

As described above, according to the second embodiment of the present invention, the distortion compensation effect can be prevented from decreasing even if the electric field strength of the received signal is changed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for decoding an AM stereo broadcasting signal of an independent sideband system, comprising:

intermediate frequency converting means for converting said AM stereo broadcasting signal to a prescribed intermediate frequency signal, envelope detecting means for envelope detection of the output of said intermediate frequency converting means to provide a stereo sum signal, a quadrature detecting means for quadrature detection of the output of said intermediate frequency converting means, distortion compensating means for compensating distortion of the output of said quadrature detecting means to provide a stereo difference signal comprising:

first amplifying means for amplifying the output of said envelope detecting means by a value a times, second amplifying means for amplifying the output of said quadrature detecting means by a value b times, multiplying means for multiplying the outputs of said quadrature detecting means and the output of said first amplifying means, addition means for adding the output of said multiplying means and the output of said second amplifying means, and matrix means for providing a right stereo signal and a left stereo signal based on the output of said envelope detecting means and the output of said distortion compensating means.

2. An apparatus for decoding an AM stereo broadcasting signal in accordance with claim 1, wherein the amplification factor a of said first amplifying means and the amplification factor b of said second amplifying means are selected to have a ratio:

$$a/b=-\tfrac{1}{2}.$$

3. An apparatus for decoding an AM stereo broadcasting signal in accordance with claim 1, wherein said distortion compensating means further comprises:

amplification factor correcting means for detecting a change of an electric field strength of said AM stereo broadcasting signal based on the output of said intermediate frequency converting means, for correcting said amplification factor a of said first amplifying means according to said change of said electric field strength.

4. An apparatus for decoding a difference signal (L−R) from a signal F:

$$F=(1+L+R)\cos(\omega t+\phi) \quad \ldots (1)$$

where $$\phi=\frac{L-R}{1+mt(L+R)} \text{ and } mt=\tfrac{1}{2},$$

said apparatus comprising:

envelope detecting means to which said signal F expressed by said equation (1) is inputted, for performing envelope detection of said input signal F, quadrature detecting means to which said signal F expressed by said equation (1) is inputted, for performing quadrature detection of said input signal F, first amplifying means for amplifying an output of said envelope detecting means by an amplification factor a, second amplifying means for amplifying an output of said quadrature detecting means by an amplification factor b, multiplying means for multiplying the output of said quadrature detecting means and an output of said first amplifying means, and addition means for adding an output of said multiplying means and an output of said second amplifying means.

5. An apparatus for decoding a difference signal (L−R) in accordance with claim 4, wherein the amplification factor a of said first amplifying means and the amplification factor b of said second amplifying means are selected to have a ratio:

$$a/b=-\tfrac{1}{2}.$$

6. An apparatus for decoding a difference signal (L−R) in accordance with claim 4, further comprising:

frequency converting means provided at a stage preceding said envelope detecting means and said quadrature detecting means for converting said signal F expressed by said equation (1) to a desired frequency signal.

7. A method for decoding a difference signal (L−R) from a signal F:

$$F=(1+L+R)\cos(\omega t+\phi) \quad \ldots (2)$$

where $$\phi=\frac{L-R}{1+mt(L+R)} \text{ and } mt=\tfrac{1}{2},$$

said method comprising:

converting said signal F expressed by said equation (2) to a signal F′ of desired frequency, detecting envelope of said frequency converted signal F′, amplifying said envelope detected signal to a value a times as much, detecting quadrature of said frequency converted signal F′, amplifying said quadrature detected signal to a value b times as much, multiplying said quadrature detected signal F′ and said a times amplified envelope detected signal, and adding said multiplied signal and said b times amplified quadrature detected signal.

8. An apparatus for decoding an AM steroe broadcasting signal of an independent sideband system, comprising:

intermediate frequency converting means for converting said AM stereo broadcasting signal to a prescribed intermediate frequency signal, envelope detecting means for envelope detection of the output of said intermediate frequency converting means to provide a signal containing a DC component, means for removing the DC component contained in the output of said envelope detecting means to provide a stereo sum signal without a DC component, quadrature detecting means for quadrature detection of the output of said intermediate frequency converting means, distortion compensating means for compensating distortion of an output of said quadrature detecting means based on the output of said DC removal means to provide a stereo difference signal, and matrix means for providing a right stereo signal and a left stereo signal based on the output of said DC removal means and the output of said distortion compensating means.

* * * * *